United States Patent [19]

Norris

[11] Patent Number: 4,523,825

[45] Date of Patent: Jun. 18, 1985

[54] FILM PROCESSING APPARATUS AND SYSTEM

[75] Inventor: Philip Norris, North Reading, Mass.

[73] Assignee: Polaroid Corporation, Cambridge, Mass.

[21] Appl. No.: 620,627

[22] Filed: Jun. 14, 1984

[51] Int. Cl.[3] ..... G03D 5/06

[52] U.S. Cl. ..... 354/301; 354/318

[58] Field of Search ..... 354/301, 303, 304, 305, 354/318, 83, 84, 85, 86, 87, 88

[56] References Cited

U.S. PATENT DOCUMENTS

| | | | |
|---|---|---|---|
| 2,558,857 | 7/1951 | Land | 95/88 |
| 3,158,523 | 11/1964 | Morrow | 156/522 |
| 3,229,605 | 1/1966 | Eloranta | 95/13 |
| 3,254,583 | 6/1966 | Land | 95/13 |
| 3,282,695 | 11/1966 | Narodny | 96/61 |
| 3,314,791 | 4/1967 | Cotta et al. | 96/76 |
| 3,314,792 | 4/1967 | Land | 96/76 |
| 3,345,165 | 10/1967 | Land | 96/29 |
| 3,615,482 | 10/1971 | Cronig | 96/48 |
| 3,640,204 | 5/1970 | Gordon | 354/318 |
| 3,680,462 | 8/1972 | Cronig | 95/89 |
| 3,826,653 | 7/1974 | Jacobs et al. | 96/50 |
| 3,907,563 | 9/1975 | Land | 96/3 |
| 3,930,859 | 1/1976 | Corrigan | 96/50 |
| 3,949,501 | 4/1976 | Andrews | 40/2.2 |
| 4,309,100 | 1/1982 | Bendoni et al. | 354/303 |
| 4,325,624 | 4/1982 | Pedroli | 354/318 |
| 4,375,324 | 3/1983 | Holmes | 354/303 |
| 4,435,062 | 3/1984 | Cocco | 354/303 |
| 4,443,530 | 4/1984 | Cronin et al. | 430/138 |
| 4,445,770 | 5/1984 | Morse | 354/303 |

*Primary Examiner*—A. A. Mathews

[57] ABSTRACT

A film processing apparatus is provided for use with cassette holding a processing sheet roll yieldably carrying, on one surface thereof, a substantially uniformly distributed supply of film processing liquid which is adapted to be applied to a surface of an exposed photographic film unit to initiate film processing. The cassette has a vapor and gas impervious housing including a film entry opening and an exit opening through which the exposed film unit and the processing sheet are advanced in superposed relation to apply the liquid to the film surface during a film processing mode of operation. To protect the processing sheet from prolonged contact with the ambient atmosphere during a non-processing mode, the apparatus is provided with system for sealing the cassette entry and exit openings.

32 Claims, 10 Drawing Figures

FILM PROCESSING APPARATUS AND SYSTEM

BACKGROUND OF THE INVENTION

The present invention relates to the field of photography and, more specifically, to processing apparatus for applying a processing sheet or web, carrying a substantially uniformly distributed supply of processing liquid thereon, to an exposed sheet-like film unit to wet an outer surface of the film unit and thereby initiate film processing.

It is well known in the prior art to process film units with a processing sheet that is soaked with processing liquid or includes a liquid carrying gel layer.

For example, the processing sheet may comprise a support carrying on one surface thereof a gel consisting of a polymer solid phase and a liquid phase comprising an aqueous alkaline processing composition. Processing is accomplished by laminating the processing sheet to the film unit with the gel in contact with an outer surface of the film whereupon the aqueous alkaline processing composition diffuses into the film and develops the exposed silver halide.

This type of processing sheet may be configured to process a variety of photosensitive materials including black and white and color self-developing diffusion transfer film units which include in a multilayer structure one or more photosensitive layers and an imaging receiving layer.

The processing sheet may be adapted to be removed from the film after an appropriate processing interval or it may be designed to be left in place permanently to act as protective cover sheet. The processing sheet support may be opaque to protect the photosensitive layer(s) from additional exposure during processing and may be left in place if applied at a non image viewing surface of the film or removed later if the film is of the type wherein the gel is to contact the image viewing surface. Alternatively, the processing sheet support may be transparent for use with film units wherein the gel is to contact the image viewing side of the film and the processing sheet is left in place to act as a transparent cover sheet.

For representative examples of processing sheet structures that employ an absorbant web soaked with a low viscosity processing liquid or utilize a processing gel carried or a support or formed as a self-supporting layer, reference may be had to U.S. Pat. Nos. 2,558,857; 3,229,605; 3,282,695; 3,615,482; 3,680,462; 3,826,653; 3,907,563; 3,930,859; and 4,443,530.

In certain applications, it may be desirable also to laminate a backing or support sheet to the underside of the film unit to provide additional stiffness and durability to the finished photograph. Furthermore, the backing sheet may be larger than film and be of an appropriate color (e.g., white) so that the marginal portions that extend beyond the edges of the film unit provide an attractive border around the finished print. For example, see U.S. Pat. No. 3,949,501 wherein an ID photograph is laminated between a transparent (non-processing) cover sheet and a border providing cover sheet. In such applications, it would be highly desirable, from an efficiency and cost standpoint, to simultaneously laminate the processing and backing sheets to opposite sides of the exposed film unit. For an example of an apparatus that includes a section for simultaneously laminating cover and backing sheets to opposite sides of an ID card, see U.S. Pat. No. 3,158,523.

One major advantage of the processing sheet method is that the processing liquid is uniformly predistributed and does not have to be mechanically spread as in the case of conventional self-developing film units wherein the liquid is held in a rupturable pod at one end of the image forming area. This means that processing apparatus for use with a processing sheet only needs a relatively inexpensive pair of pressure rollers to urge the sheet and film into good contact rather than very expensive precise rollers, used with the more conventional pod type film unit, that function to rupture the pod and then spread the liquid uniformly between predetermined layers of the film unit.

There is, of course, a drawback to the processing sheet or web method in that chemically active processing liquids, such as aqueous alkaline developers, must be protected from prolonged atmospheric contact before use. If the processing sheet is exposed to air for a long period of time, some of the liquid may be lost by evaporation and/or the liquid may be contaminated or suffer diminished chemical activity because of its reaction with atmospheric gases such as oxygen and carbon dioxide.

The liquid carrying processing medium may be produced in single sheet units dimensioned to cover a single film unit or in the form on an elongated web roll used for high volume production wherein a predetermined length of the processing wet is cut from the roll just prior to or after lamination. The processing sheets or rolls generally are packaged in vapor and gas impervious containers or bags at manufacture which provides protection against atmospheric contact until the sheet or web is to be used. An individually packaged sheet presents no problem in that it is used immediately upon being removed from its protective packaging. However, an elongated processing web roll is used intermittently, a length at a time, and some protection against prolonged atmospheric contact must be provided for the unused portion of the roll once the protective package is removed or opened.

Commonly assigned U.S. Pat. Nos. 3,229,605; 3,254,583; 3,314,791; 3,314,792; and 3,345,165 disclose various embodiments of a self-developing camera and a compatible cassette holding a roll of processing web that is soaked with a low viscosity processing liquid. The camera and/or cassette include structure for isolating that portion of the roll left in the cassette from the ambient atmosphere when the camera is in its non-processing mode.

The cassette comprises a vapor and gas impervious housing formed around the processing web roll. The housing has a single exit opening or slot through which the web is advanced in increments to present an appropriate length of web at a pair of pressure rollers which are used to laminate the web to a length of exposed film. A knife assembly on the exit side of the rollers is provided for severing the laminate from the trailing processing web and film strip.

The cassette exit opening is sealed at the factory so the web is protected until the seal is broken just before the cassette is inserted into the camera. In one embodiment, the edges of the exit opening are resilient and overlap to clamp the protruding web between integrally formed ribs to inhibit vapor and gases transmission through the exit open. Thus the cassette itself includes means for isolating the processing web or sheet from the ambient atmosphere. In another embodiment, the cassette is provided with a pair of compliant outwardly extending lips on opposite sides of the exit open and the camera includes means for selectively applying a compressive pressure to the lips to clamp the protruding portion of the web therebetween and thus ilsolate the portion of the roll inside the cassette from the ambient atmosphere.

In this system, the processing web is advanced along one path of travel into the nip of the pressure rolls while the film unit is advanced along a path that is substantially perpendicular to the web path. This means that the convergent paths must be set to fairly precise tolerances if the film and web are to be in proper registration alignment when they enter the bite of the rollers. Such tight tolerance requirement, of course, increase the cost of the processing components. Also, no provision is made for simultaneously laminating a backing sheet to the underside of the film unit.

Therefore it is an object of the present inventor to provide a low cost and easy to use film processing apparatus having processing and non-processing modes of operation, and including means for isolating a processing sheet or web carrying a substantially uniformly distributed supply of processing liquid from the ambient atmosphere surrounding the apparatus when the apparatus is in its non-processing mode.

Another object is to provide such an apparatus that is configured for use with a processing sheet cassette having both entry and exit openings.

Yet another object is to provide such an apparatus that includes provision for simultaneously applying a processing sheet and a backing sheet to opposite sides of an exposed film unit.

Another object is to provide a low cost and easy to use film processing system comprising a film processing apparatus in combination with a cassette holding a processing sheet.

Yet another object is to provide such a system wherein the cassette includes means for properly aligning film unit with respect to the processing sheet.

Still another object is to provide a cassette holding both a processing sheet and a back sheet, which is configured for use with a film processing apparatus.

Other objects of the invention will, in part, be obvious and will, in part, appear hereinafter.

SUMMARY OF THE INVENTION

The present invention provides a film processing apparatus and a film processing system comprising the film processing apparatus and a cassette holding a processing sheet carrying a substantially uniformly distributed supply of a processing liquid which is adapted to be applied to a surface of an exposed film unit to initiate processing thereof. The apparatus and cassette include components which cooperate to effectively isolate the processing sheet from the ambient atmosphere surrounding the apparatus when film is not being processed. The purpose for isolating the processing sheet is to guard against loss of liquid by evaporation and/or contamination or degradation of chemical activity of the liquid by reaction with atmospheric gasses such as oxygen and carbon dioxide.

The film processing apparatus has processing and non-processing modes of operation. It is configured for use with a cassette holding a processing sheet yieldably carrying, on one surface thereof, a substantially uniformly distributed supply of processing liquid.

The cassette is of the type having a housing formed of a vapor and gas impervious material and includes an entry opening, through which an exposed film unit advanced along an entry path of travel is moved into the cassette, and an exit opening through which the film unit and processing sheet are advanced simultaneously, along an exit path of travel, in superposed relation with the processing liquid carrying surface facing a surface of the film unit adapted to be wetted with the processing liquid to initiate film processing.

The apparatus includes the first and second sections. The first section is engageable with the cassette and includes a first seal moveable between a non-processing mode closed position for blocking the film entry path and isolating the entry opening from the ambient atmosphere surrounding the apparatus, and a processing mode position for unblocking the film entry path to provide access to the entry opening. The second apparatus section is engageable with the cassette and includes means for advancing the superposed processing sheet and film unit along the exit path of travel while applying a compressive pressure thereto to urge the processing liquid into contact with the facing film surface, and a second seal moveable beween a non-processing mode closed position for blocking the exit path and isolating the exit opening from the ambient atmosphere surrounding the apparatus, and a processing mode open or aligned position for unblocking the exit path to permit advancement of the superposed processing sheet and film unit therealong.

In the illustrated embodiment, the processing sheet is provided in the form of a processing web roll that is advanced, a length at a time, from the cassette and is severed from the roll following lamination to the film unit. The processing web preferably comprises a flexible base or support sheet having on one surface thereof a gel yieldably carrying the processing liquid. Also, the cassette preferably houses a roll of backing sheet which is simultaneously laminated to the backside of the film unit and severed with processing sheet.

The apparatus includes means for controlling movement of the first and second seals so that they move between their respective open and closed positions in a coordinated manner.

The cassette preferably has the entry and exit openings on the opposite side of the cassette housing and the apparatus is configured so that the first and second apparatus sections are moveable relative to one another between an inoperative retracted position, wherein the sections are spaced apart far enough to allow the cassette to be inserted easily therebetween, and an operative engaging position wherein the first and second sections are moved closer to each other, than when in the retractive position, so they firmly engage opposite sides of the cassette to locate the cassette at its operative position within the apparatus. The apparatus preferably includes a simple lever mechanism for moving the first and second apparatus sections between the retracted and engaging positions.

BRIEF DESCRIPTION OF THE DRAWINGS

For a fuller understanding of the nature and objects of the invention, reference should be made to the following detailed description and the accompanying drawings wherein.

DESCRIPTION OF THE PREFERRED EMBODIMENT

Figure 1:
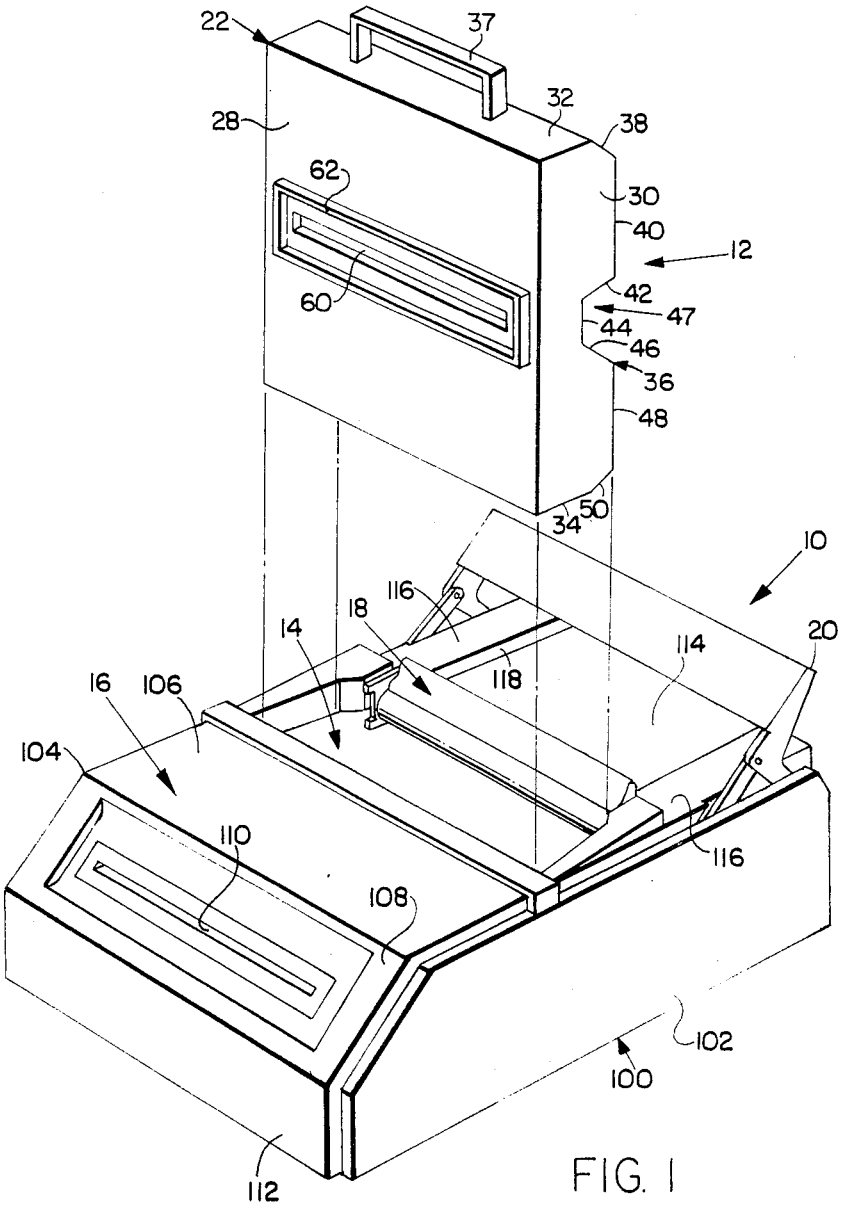
FIG. 1 is perspective view of the processing apparatus and cassette embodying the present invention with the apparatus shown in its inoperative retracted position and a cassette positioned above a cassette receiving well in the apparatus.
Figure 2:
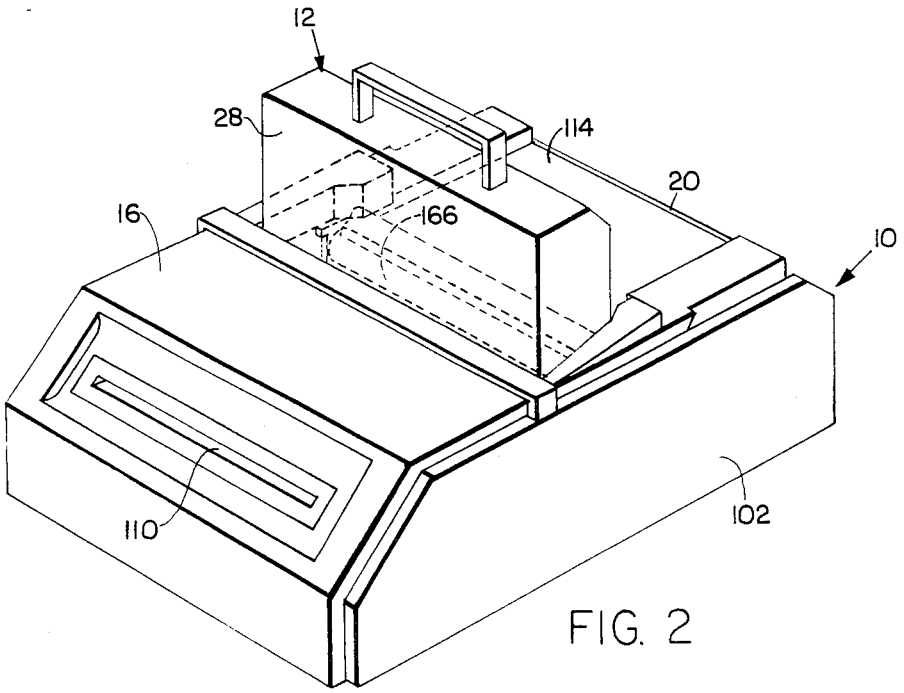
FIG. 2 is a perspective view showing the cassette located at its operative position within the apparatus with first and second apparatus sections located in the operative cassette engaging position.

With reference to FIGS. 1 and 2, the present invention provides a film processing apparatus 10 and a compatible cassette 12, holding film processing materials, which together form a film processing system.

In FIG. 1, the apparatus 10 is show in its non-operative retracted position in preparation for receiving cassette 12 in a receiving well or chamber 14. As will become apparent later, apparatus 10 includes a fixed forward section 16 and a slideable rear section 18 which is moved rearwardly, in response to lifting a pivoting lever handle 20 to its illustrated upwardly extending position, to space sections 16 and 18 apart sufficiently so that cassette 12 may be easily inserted into and withdrawn from well 14.

Once the lower portion of cassette 12 is seated in well 14, lever handle 20 is pivoted downwardly causing the rear section 18 to slide forwardly thereby setting apparatus 10 in its operative cassette engaging position shown in FIG. 2.

Figure 3:
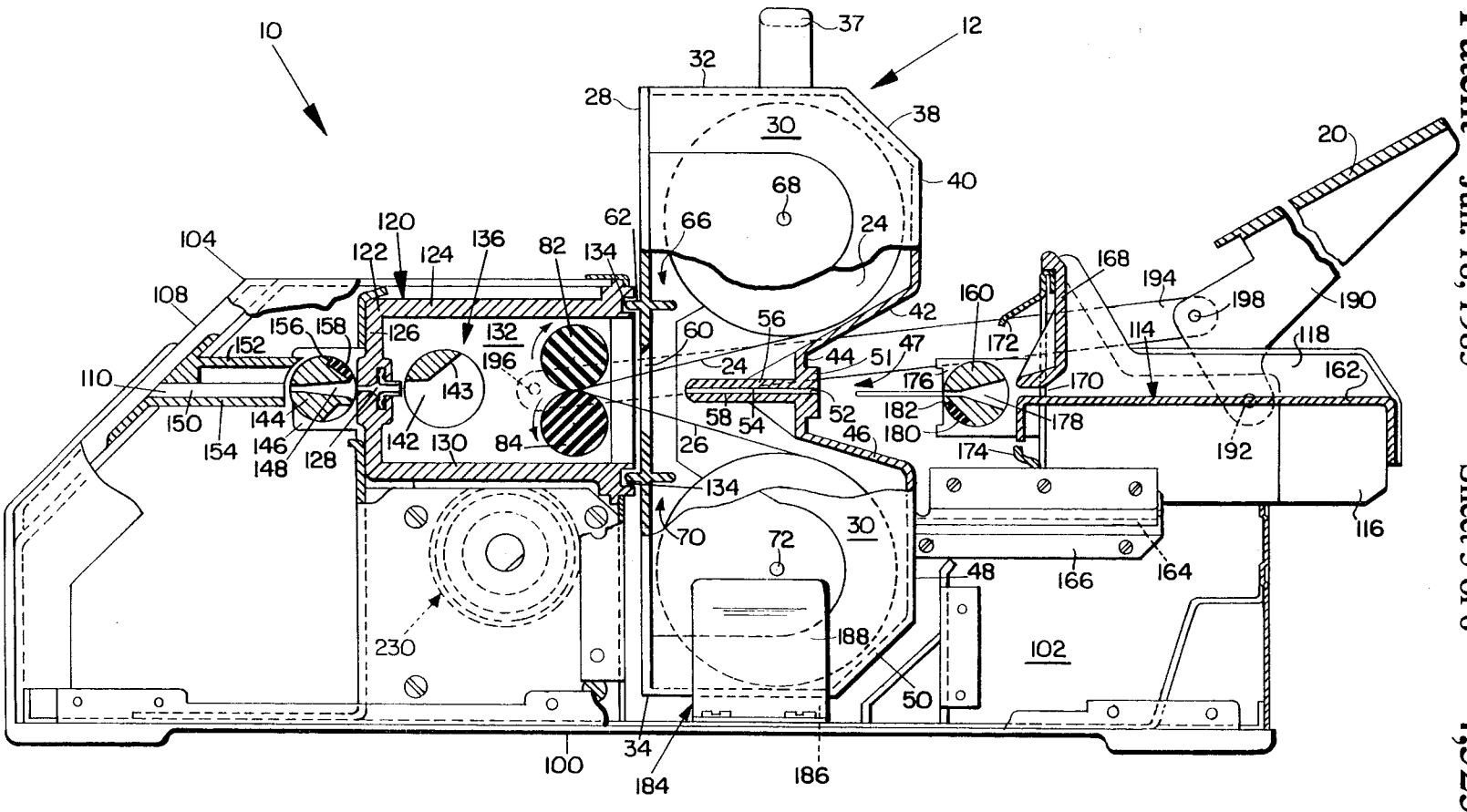
FIG. 3 is a longitudinal cross-sectional view of the apparatus showing the cassette located at its operative position and the first and second apparatus sections located in the retracted position.
Figure 4:
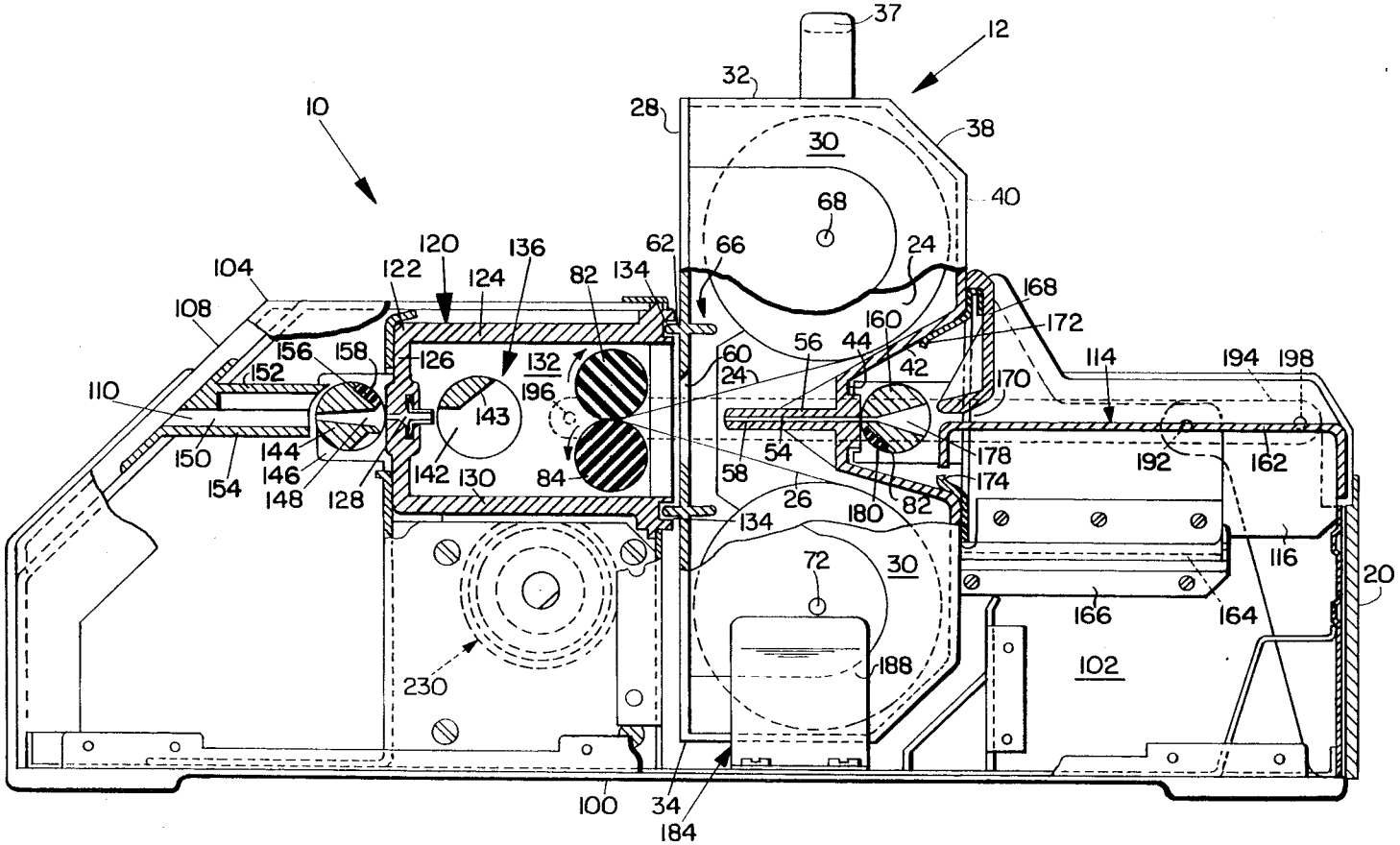
FIG. 4 is similar in some respects to FIG. 3 but shows the first and second apparatus sections located in their respective operative cassette engaging positions.

With additional reference to FIGS. 3 and 4, cassette 12 comprises a box-like housing 22 enclosing therein a roll of film processing sheet 24, adapted to be laminated to the upper surface of an exposed film unit to initiate processing thereof, and a roll of base or backing sheet 26 adapted to be laminated, simultaneously with the processing sheet 24, to the underside of the exposed film unit to provide additional support. Depending on the type of film unit being processed, base sheet 26 may also serve as an opaque cover sheet for the underside of the film unit to prevent further exposure of photo-sensitive materials therein during film processing.

Cassette 12 is defined by a plurality of walls including a forward wall 28, a pair of oppositely spaced lateral side walls 30, a top wall 32, a bottom wall 34, and a rear wall 36. Optionally, the cassette also may include a carrying handle 37 attached to top wall 32.

As best shown in FIGS. 3 and 4, wall 36 is formed, in top to bottom sequence, by a short incline panel 38, adjacent to top wall 32, a vertical upper panel 40, and inwardly extending incline panel 42, a short vertical center panel 44, a second inwardly extending incline panel 46, a vertical lower panel 48 and a short incline panel 50 adjacent bottom wall 34. Panels 42, 44 and 46 define a laterally extending indentation on notch 47 in the rear wall 46 of the cassette. Cassette 12 is structured this way to reduce the depth of the cassette between center panel 44 and the facing portion of forward wall 28.

The center panel 40 of rear wall 36 has a horizontal, laterally extending and outwardly projecting boss 51 having a film entry slot 52 formed therein leading into a narrow horizontal film guide channel or passageway 54 formed by internal upper and lower horizontal film guide plates 56 and 58. Plates 56 and 58 are fixed to rear center panel 44, above and below entry slot 52 respectively, and project forwardly within the cassette toward a horizontal, laterally extending opening or slot 60 formed in forward wall 28. The lateral ends of plates 56 and 58 preferably are fixed to the interior surfaces of cassette side walls 30 for additional support.

As best shown in FIG. 1, forward wall 28 has an outwardly projecting rectangular rib structure 62 thereon surrounding the exit opening 60. As will become apparent later, rib 62 is adapted to be received in a complimentary rectangular channel within apparatus section 16 to form a vapor and gas impervious seal around exit opening 60 when cassette 12 is located at its operative position in well 14.

As best shown in FIGS. 3 and 4 the guideway plates 56 and 58 are located between an upper chamber 66 for enclosing the roll of processing sheet 24, which is rotatably supported on an axial shaft 68 extending between side walls 30, and a lower chamber 70 for enclosing the roll of base sheet 26 which is rotatably supported on axial shaft 72 extending between cassette side walls 30.

The leading end of processing sheet 24 passes over the upper plate 56 and then out of cassette 12 through exit opening 60. Similarly, the base sheet 26 passes under the lower guide plate 58 and out through exit slot 60 in facing relation to processing sheet 24. The exit paths of travel of the processing sheet 24 and base sheet 26 converge with the film unit path of travel through guide channel 54 and opening 60 at a point just forwardly of forward wall 28. Thus, a film unit fed into the cassette through entry slot 52 and along the guide channel 54 emerges through opening 60 in between the facing sheets 24 and 26 in position to be advanced between a pair of later to be described pressure rollers in apparatus 10.

The processing sheet 24 includes a flexible base or support carrying thereon a substantialy uniformly supply of a processing liquid which is adapted to be applied to a surface of the exposed film unit to initiate film processing. The base may be an absorbant material that is soaked with a low viscosity processing liquid or may be a flexible carrier sheet having a gel coating, on one surface thereof, which consists of a polymer solid phase and a processing liquid phase.

Figure 5:
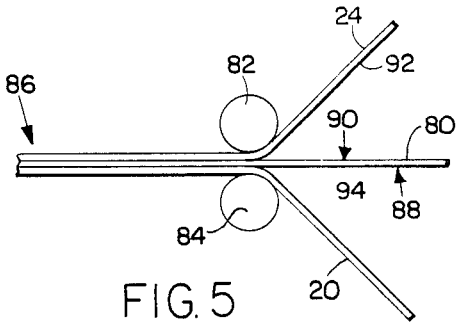
FIG. 5 is a diagrammatic view of the processing sheet, film unit, and backing sheet being advanced between a pair of pressure rollers to form a laminate.

To diagrammatically illustrate the processing method used in the present invention, a sheet-like film unit 80 is shown on FIG. 5 being advanced through a pair of compressive pressure applying rollers 82 and 84 between the processing sheet 24 and the base sheet 26 to form a laminate 86 on the exit side of the rollers.

For the purposes of illustration, it will be assumed that the film unit 80 is of the integral self-developing type which includes, in a multi-layered structure, one or more photo-sensitive layers and an image receiving layer. It will be further assumed that film unit 80 is designed to be exposed by directing image forming light at its underside surface 88 and thereafter to be processed by wetting the upper surface 90 with an aqueous alkaline processing liquid to initiate a development and diffusion transfer process which results in the production of a positive image that is viewable through surface 90. A film unit of this type generally includes an opaque layer therein for blocking transmission of actinic radiation incident upon surface 90 to the photosensitive layer or layers. However, if at least part of the processing is to take place in an actinic light environment, e.g., outside of processing apparatus 10, then the underside surface 88 should be covered with an opaque sheet or layer to prevent further exposure of the photo-sensitive materials during the film processing interval.

In this example, it is also assumed that the processing sheet 24 comprises a flexible base or support sheet carrying on surface 92 thereof a gel comprising a polymer solid phase and a liquid phase consisting of an aqueous alkaline processing composition. If the processing sheet 24 is to be removed from film unit viewing surface 90 after a suitable processing interval, then the base sheet may be opaque. However, if sheet 24 is to permanently remain as part of laminate 86, so as to serve as a protective cover sheet, then the processing sheet base structure will be transparent. For representative examples of processing sheets 24 and film units 80 that may be adapted for use in connection with the present invention, reference may be had to U.S. Pat. Nos. 2,558,857; 3,345,165; 3,615,482; 3,680,462; 3,907,563; 3,930,859; and 4,443,530.

The base of support sheet 26 preferably is an opaque polymer sheet formed, for example, of polyethylene or polystyrene or the like and including a tacky adhesive coating on surface 94 facing the film unit bottom surface 88.

The processing and support sheets 24 and 26 preferably are equal in width and slightly wider than the width of the film unit 80 so when the laminate 86 is formed, the lateral margins of sheets 24 and 26 extend out beyond the lateral edges of the film unit and are bonded directly to each other during lamination. As will become apparent later, the laminate is adapted to be severed from the trailing lengths of sheets 24 and 26 behind the trailing end of film unit 80. Preferably, the severing operation is designed to cut the sheets 24 and 26 so they are slightly longer than the film unit 80 to provide longitudinal margin areas extending beyond the leading and trailing ends of the film unit 80 where sheets 24 and 26 are bonded directly to each other. Preferably, the opaque base sheet 26 is of an appropriate color (e.g. white, beige, etc.) so that the marginal portions of sheet 26 extending beyond the peripheral edges of the film unit 80 form an attractive border surrounding the finished photograph. When the laminate 86 is formed by passing the three-sheet components between the pressure-applying rollers, the gel is pressed into contact with surface 90 of the film unit 80 thereby wetting it with the processing liquid which diffuses into the film unit structure and initiates the development and diffusion transfer process. Because the opaque sheet 26 covers the underside film surface 88, the laminate may be advanced out of the processing apparatus 10 into the ambient light without causing further exposure of the photosensitive materials in film unit 80.

A major advantage of the processing sheet method is that the processing liquid is predistributed on the support in a substantially uniform manner during manufacture and does not have to be spread over the film unit during processing as is common with more conventional self-developing film units having the processing liquid contained in a rupturable pod attached to the leading thereof.

However, in exchange for this convenient advantage, steps must be taken to avoid exposing the processing sheet 24 to prolonged contact with the atmosphere between manufacture and use. If the processing sheet 24 is exposed to changing volumes of air over a prolonged period, some of the processing liquid will be lost due to normal evaporation and/or the liquid may suffer deterioration of its chemical properties due to chemical reactions with atmospheric gases such as oxygen and carbon dioxide.

To isolate the roll of processing sheet 24 in cassette 12 from the ambient atmosphere from the time of manufacture until cassette 12 is to be inserted into apparatus 10, the cassette housing 22 is formed of a vapor and gas impervious material, preferably a plastic material such as polyethene or the like, which also is relatively chemically inert with respect to the aqueous alkaline processing liquid. To prevent air from entering the cassette housing 22 before cassette 12 is ready for use, temporary vapor and gas impervious tape seals (not shown) are placed over the rear film entry opening 52 and the forward exit opening 60. These seals may take the form of metal foil and polymer sheet laminates which are attached to the cassette housing 22 in covering relation to openings 52 and 60 by means of a readily strippable adhesive. When the cassette 12 is sealed in this manner, the processing sheet roll is exposed only to the relatively small volume of air within the cassette housing which reaches a stabilized processing liquid vapor saturation level thereby impeding evaporation. Also, the small amount of oxygen and carbon dioxide associated with the air in this controlled space volume of the cassette housing is insufficient to cause any significant contamination of the processing liquid carried on processing sheet 24.

Just before cassette 12 is placed in apparatus 10, the sealing strips over the cassette entry and exit openings 52 and 60, respectively, are removed. As will become apparent later, apparatus 10 includes a sealing system that operates in conjunction with cassette 12 for effectively isolating the processing sheet 24 from the ambient atmosphere surrounding apparatus 10 when apparatus 10 is in its non-processing mode.

The film processing apparatus 10 is designed to function in a film processing mode for laminating the processing sheet 24 and base sheet 26 to opposite sides of an exposed film unit 80 to form laminate 86, and for severing the laminate from sheets 24 and 26. Apparatus 10 also functions in a non-processing mode for blocking off or effectively sealing the cassette openings 52 and 60 to minimize the exposure of the processing sheet roll to the ambient atmosphere surrounding apparatus 10 when it is not being used to process film.

With reference to FIGS. 1 through 4, the apparatus 10 is a box-like device which includes the fixed forward section 16, the cassette well 14 and the rear section 18 behind well 14 that is moveable between the inoperative retracted position of FIGS. 1 and 3 and the operative cassette engaging position of FIGS. 2 and 4.

Apparatus 10 includes a bottom wall or base plate 100 and a pair of laterally spaced, longitudinally extending, upstanding side walls 102 attached to base plate 100 to form a generally u-shaped frame for mounting and supporting various components of apparatus 10. The forward section 16 has a removable cover section 104, extending between side walls 102, which is defined by a horizontal top panel 106, a downwardly incline panel 108 having a horizontally extending laminate exit slot 110 therein, and a vertical leading end bottom panel 112.

Rear section 18 is slideably mounted between the side walls 102 for longitudinal movement between its retracted and engaging positions and includes a horizontal surface 114 which is bounded on its lateral sides by a pair of upstanding longitudinally extending guide rails 116. As will become apparent later, surface 114 and the interior vertical edge surfaces 118 of rails 116 serve as guide surfaces along which the exposed film unit 80 slides to guide it into the entry opening 52 of cassette 12.

As best shown in FIGS. 3 and 4, the forward section 16 has a processing module 120 therein against which the forward wall portion of cassette 12 is adapted to be pressed to releaseably seal the forward side of cassette 12 to the rear side of module 120 and locate the exit slot 60 in the cassette in communicating relation with module 120.

Module 120 includes a laterally extending hollow housing or shell 122, formed of any suitable vapor and gas impervious material such as sheet metal, fixedly mounted between side walls 102. Shell 102 includes a top wall 124, a leading end wall 126 having an exit opening 128 therein, a bottom wall 130, and a pair of oppositely spaced lateral side walls 132. Shell 122 is open at its trailing end facing well 14. The trailing ends of walls 124, 130 and 132 are formed with recesses therein to define a rectangular channel 134 at the rear of shell 122 for receiving the complimentary rectangular sealing rib 62 on cassette forward wall 28 surrounding the exit opening 60 therein. Although not shown in the drawings for visual clarity, the channel 134 preferably has a resilient rubber or foam gasket therein to insure that rib 62 fits snugly within channel 134 to effect a vapor and gas impervious seal between the cassette 12 and the trailing end of module 120.

The interior surfaces of shell 122 define an internal chamber 136 having rotatably mounted therein a pair of compressive pressure applying rollers 82 and 84 for advancing the sheets 24 and 26 and a film unit 80 therebetween along a film exit path while applying a compressive pressure thereto to form laminate 86, and a rotary knife 142 having a cutting edge 143 for severing the trailing end of laminate 86.

Located in front of the exit slot 128 in shell 122 is a horizontal, laterally extending, cylindrical, rotary seal 144 that serves to selectively seal or block the exit opening 128.

The seal 144 is in the form of an elongated cylinder, preferably formed of a metal such as aluminum or a high-strength plastic. It is rotatably mounted between a pair of flanges 146 projecting forwardly of shell side walls 132 to locate the backside of the cylindrical seal in sliding frictional contact with the center portion of shell forward wall 126 having exit slot 128 therein.

Extending through seal 144 is a tapered guide slot 148 having its wider open end aligned with the exit slot 128 and its narrower forward end aligned with a laminate passageway or channel 150, formed by plates 152 and 154 on the interior side of panel 108, leading to the laminate exit slot 110. Additionally, the seal 144 has a laterally extending recess 156 in its exterior surface, above the wider end of tapered slot 148, holding therein a resiliently deformable seal member or gasket 158 made of rubber or the like.

Figure 6:
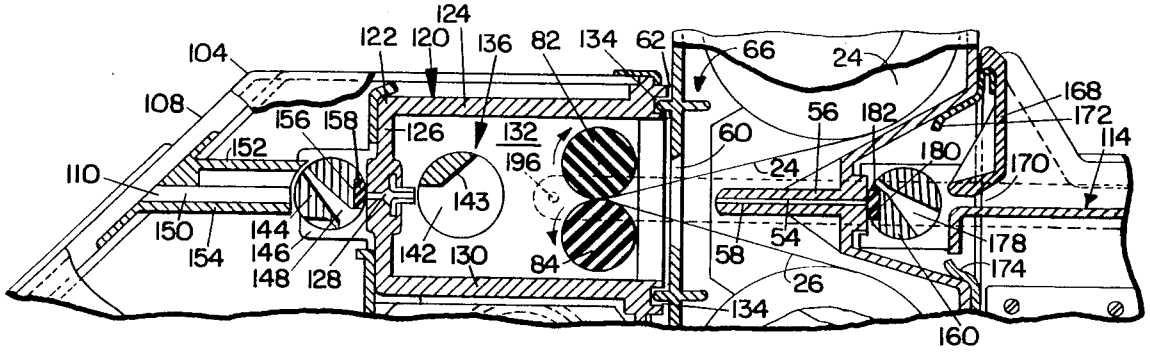
FIG. 6 is a longitudinal cross sectional view of a portion of the apparatus showing the rotary seals in the closed or blocking positions.

In response to rotating seal 144 in the clockwise direction through an arc of approximately 45°, it is shifted from its aligned processing position of FIGS. 3 and 4 to its sealing position shown in FIG. 6 wherein seal member 158 is in frictional engagement with the center portion of wall 126 so at to block or seal off the exit slot 128.

With the rear end of the impervious module 120 releasably sealed to cassette 12 around the exit slot 60, and the blocking off of the exit path of travel through opening 128 with seal 144 located in its sealing position of FIG. 6, the exit opening 60 of cassette 12 is effectively isolated from the ambient atmosphere surrounding apparatus 10. While there is air in the chamber 136 of module 120, the volume is relatively small and it will not significantly effect the gel on processing sheet 24.

The moveable rear section 18 has a similar rotary seal 160 mounted thereon for selectively sealing or blocking off the cassette opening 52 on the backside of cassette 12.

The film guide surface 114 of section 18 is formed by a wall member 162 which extend between the side rails 116. Rails 116 have outwardly extending horizontal flanges 164, near the bottom edges thereof, which are captured in corresponding supporting guideways 166 mounted on side walls 102 thereby mounting section 18 for longitudinal sliding movement between its retracted position of FIG. 3 and its cassette engaging position of FIG. 4.

Mounted between the forward ends of rails 116 and over surface 114 is a forward wall member 168 which is configured at its lower end to cooperate with surface 114 for defining a tapered film unit passageway or slot 170 therebetween. Member 168 also mounts, on the forward side upper end thereof, a downwardly sloping spring member 172 which is adapted to engage the downwardly sloping rear panel 42 of cassette 12 when section 18 is in its cassette engaging position. A second spring member 174 is mounted on a lower portion of section 18 for engaging panel 46 of cassette 12.

The second rotary seal 160 is mounted between a pair of forwardly projecting flanges 176 carried on side rails 116. Seal 160 includes a tapered pass-through slot 178 and has a resiliently deformable seal member 180 set in a laterally extending recess 182.

The cassette receiving well 14, between the rear end of section 16 and the forward end of section 18, is formed in part by a generally U-shaped laterally extending cassette receiving and locating clip 184 mounted on bottom wall 100. The bottom wall 34 of cassette 12 is adapted to sit on the top surface of a clip cross bar 186 which sets the vertical location of cassette 12 within well 14. The lower ends of cassette side walls 30 are adpated to be engaged by a pair of resilient upstanding side clips 188 on the lateral ends of cross bar 186 for positioning cassette 12 at its correct lateral location within well 14. With rear section 18 retracted, there is sufficient space between section 16 and 18 so that the rectangular rib 62 on the front of cassette 12 clears the trailing end of module 120 as cassette 12 is inserted into well 14. When cassette 12 is located at its fully inserted position in clip 184, said cassette is correctly positioned in well 14 so that the rectangular rib 62 is aligned with the complimentary receiving channel 134 formed in shell 122.

As best shown in FIG. 4, once cassette 12 is seated in well 14, the rear section 18 is moved forwardly to engage the rear of cassette 12 and push it forwardly to firmly press it against module 120 and seat rib 62 in channel 134. Also, the rear seal 160 is in firm frictional engagement with the cassette rear center panel boss 51 to locate seal 160 in operative relation with the cassette film entry's opening 52. In the film processing mode, seal 160 is positioned to locate its pass-thru opening or slot 178 in alignment with the film passageway 170 on section 18 and the cassette entry opening 52. In the nonprocessing mode, seal 160 is rotated in the clockwise direction through an arc of approximately 45° so that seal member 160 seals or blocks off the film entry opening 52 as shown in FIG. 6. With rotary seals 144 and 160 located in their respective blocking or closed postions sealing off openings 128 on module 120 and the entry opening 52 on cassette 12, the processing sheet 24 is isolated from the ambient atmosphere surrounding apparatus 10 and is confined within a controlled volume of air occupying the interior of cassette 12 and the communicating chamber 136 of module 120. The amount of air in this controlled volume is relatively small and it will not cause any significant evaporation or contamination of the processing liquid carried in the gel layer on processing sheet 24.

To insure that the front seal formed by rib 62 extending into channel 134 and the rear seal formed by seal 160 are tight and impervious to atmospheric vapor and gases, and rear section 18 must be pressed firmly against the rear of cassette 12 so that there is an adequate compressive force established to operatively seat the rear and front seals.

To facilitate the compressive loading of cassette 12, apparatus 10 includes a mechanically advantaged lever system for moving section 18 into and out of engagement with cassette 12. The lever system comprises lever handle 20 which extends across the rear of section 18 and terminates at its lateral ends in a pair of bell-crank flanges 190 that are pivotally connected, at their lower ends, to the rails 116 on section 18 at pivot pins 192, and a pair of elongated links 194, each having its forward fixed end pivotally connected to the corresponding side wall 102 on section 16, adjacent the rollers, at pivot pin 196 and its rear end pivotally coupled to the corresponding bell-crank flange 190 at pivot pin 198.

As best shown on FIG. 3, handle 20 is raised to locate section 18 at its rearwardmost or retracted position. In response to the operator manually pushing down on handle 20, the bell-crank flanges 190 pivot in the clockwise direction about pins 198 driving the lower end of the cranks 190 forwardly which in turn drive section 18 forwardly toward the cassette 12 in well 14. When the handle 20 is all the way down in the cassette engaging position shown on FIG. 4, the link pins 198 are substantially in line with or slightly below the forward pivot pins 192 to maintain the compressive loading of cassette 12. The cassette is released simply by rotating handle 20 upwardly in the opposite direction to drive section 18 rearwardly.

The seals 144 and 160 are preferably normally located in the closed or sealing positions of FIG. 6 and are moved to the open or aligned positions only during the film processing mode of operation.

Figure 8A:
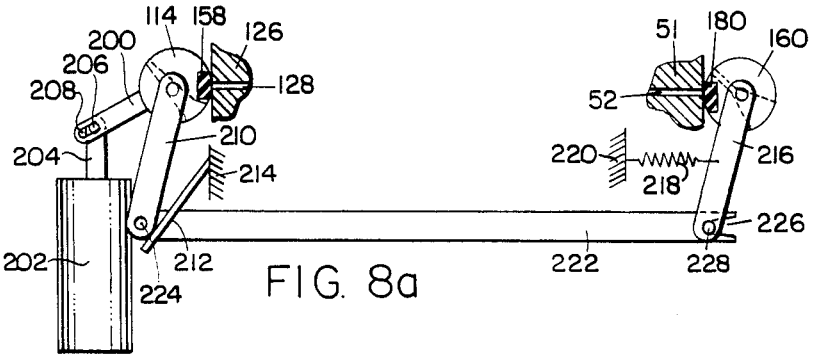
FIGS. 8A and 8B are diagrammatic illustrations of a solenoid operated system for simultaneously rotating the seals, showing the seals in the aligned and blocking positions respectively.
Figure 8B:
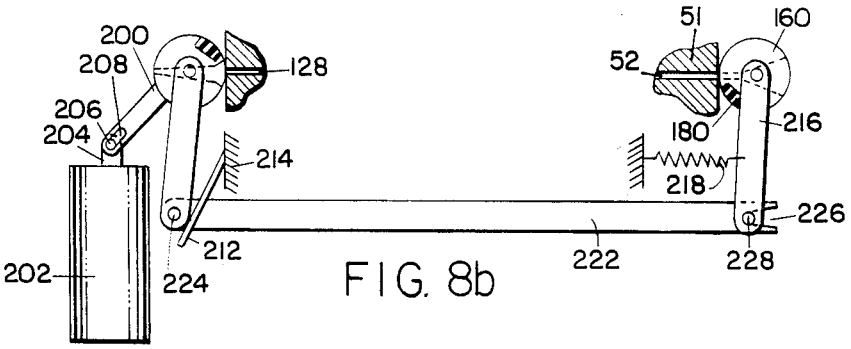

One arrangement for operating the seals 144 and 160 with an electrical solenoid is shown diagrammatically in FIGS. 8A and 8B. The forward seal 144 has a bell-crank 200 attached to its distal end. Crank 200 is operated by a solenoid 202 having its retractable plunger 204 coupled to the crank by means of a plunger pin 206 that rides in an elongated slot 208 in the lower portion of crank 200. A second bell-crank 210 is fixed to the opposite end of seal 144 and is engaged, near its lower end, by a leaf spring 212 mounted on a frame member 214 in section 16. Spring 212 urges the lower end of crank 210 forwardly thereby providing a clockwise biasing moment on seal 144 so that it normally assumes the sealing position of FIGS. 6 and 8A. When solenoid 202 is energized, plunger 204 retracts as shown in FIG. 8B and applies a downward force on crank 200 which results in the application of a counter clockwise moment force on seal 144. The force applied by solenoid 202 is sufficient to overcome the normal biasing force provided by spring 212 so that seal 144 rotates in the counter clockwise direction from the sealing position of FIGS. 6 and 8A to the aligned position shown in FIGS. 4 and 8B. When solenoid 202 is deenergized, the spring 212 returns seal 144 to its normal position blocking opening 128.

In the illustrated embodiment, the rear seal 160 has a bell-crank 216 attached to its near end. A clockwise biasing force is applied to seal 160 by means of a coil spring 218 connected between crank 216 and a frame member 220 mounted on base plate 100.

A motion following connection between the two seals is provided by an elongated follower link 222 which has its forward end pivotally connected to the lower end of crank 210, at pin 224, and has a V-shaped notch 226, at its trailing end, which receives a fixed pin 228 on the lower end of crank 216 when the seal 160 is located in its operative position in response to moving section 18 to the cassette engaging position. Link 222 is supported in its horizontal position by a guide member on an internal frame (neither shown) so that it remains in place when pin 228 is withdrawn in response to moving section 18 to the retracted position.

When seal 144 is rotated in the counter clockwise direction by the solenoid 202, the motion of crank 210 is transmitted to crank 216 by link 222 so that seal 160 is rotated silmutaneously therewith. Upon deenergizing solenoid 202, seal 144 is restored in its normal sealing position by spring 212 and seal 160 is restored to its sealing position by spring 218.

The pressure applying rollers 82 and 84 are adapted to be rotatably driven in the direction shown by the arrows in FIG. 3 by means of an electrical motor 230, mounted in section 16 under module 120, that is connected to the rollers through a suitable gear train (not shown). The rotary cutting knife 142 is spring biased into its normal non-cutting position with cutting edge 143 positioned over the laminate exit path by a torsion spring (not shown) and is rotatably driven in the clockwise direction to pass the cutting edge 143 through the exit path and sever the trailing end of the laminate 86 by solenoid (not shown) that acts on a bell-crank (not shown) attached to one end of knife 142.

Figure 9:
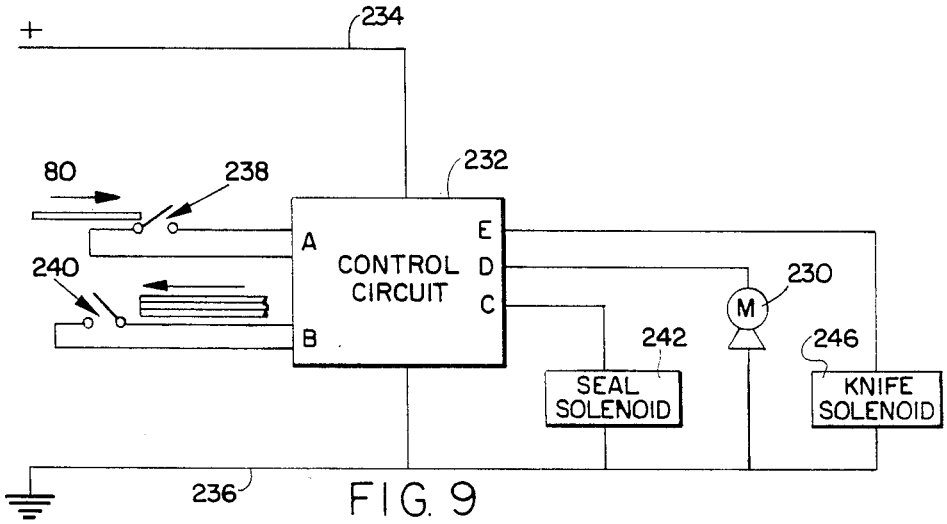
FIG. 9 is a block diagram representation of a control system suitable for use in the processing apparatus embodying the present invention.

Apparatus 10 also includes means for controlling the operation of the various electrical components in a coordinated manner. There are any number of suitable control system configurations known in the art for performing the necessary control functions which will be described with reference to a representative control system 230 shown in block diagram form in FIG. 9.

System 230 includes a control logic and power distribution control circuit 232 connected between an AC power input line 234 and a ground line 236. Circuit 232 may include a programmable microprocessor to direct the logic and power distribution function. Alternatively, logic and power distribution may be provided by a plurality of switches which are operated in an appropriate sequence by an electro-mechanical timer.

Input signals to circuit 232 are provided by a first normally opened sensor switch 238 connected to input A and a second normally opened sensor switch 240 connected to input B. Switch 238 is located in the film insertion passage way 170, just before seal 160, and is adapted to be engaged by a film unit 80 located therein to move it to its closed position and thereby provide a logic signal to input A indicating the presence of a film unit 80 in passageway 170. Similarly, switch 240 is located in the laminate exit path of travel through laminate exit slot 110 to provide a logic signal to input B indicating the presence of a laminate 86 in slot 110.

Based on the input signals, circuit 232 controls the flow of electrical energy to a seal solenoid 242 connected between output C and ground, the roller drive motor 230 connected between output D and ground, and a knife solenoid 246 connected between output D and ground.

Apparatus 10 is normally in its non-processing mode with switches 238 and 240 in the open position providing low level logic 0 inputs at A and B. In response to the logic 0 inputs there is no output from circuit 232, so the solenoids 242 and 246 and motor 230 are not energized. Thus, the rotary seals 144 and 160 are located in their normal sealing positions shown in FIGS. 6 and 8A.

As will be explained later, the leading ends of the processing sheet 24 and base sheet 26 normally remain captured in the nip of the rollers 82 and 84 ready to be advanced therebetween in response to rotation of the rollers.

To initiate the processing mode, the operator places an exposed film unit 80 on the guide surface 114 with the film surface to be contacted with the processing liquid facing upwardly and manually slides the film unit into the passageway 170. The leading end of the film unit 12 rides over the actuator arm of switch 238 and deflects it downwardly to close switch 238 thereby providing a high level logic 1 input at A. As long as any portion of film unit 80 is located over the switch actuator, switch 238 remains in its closed position.

Figure 7:
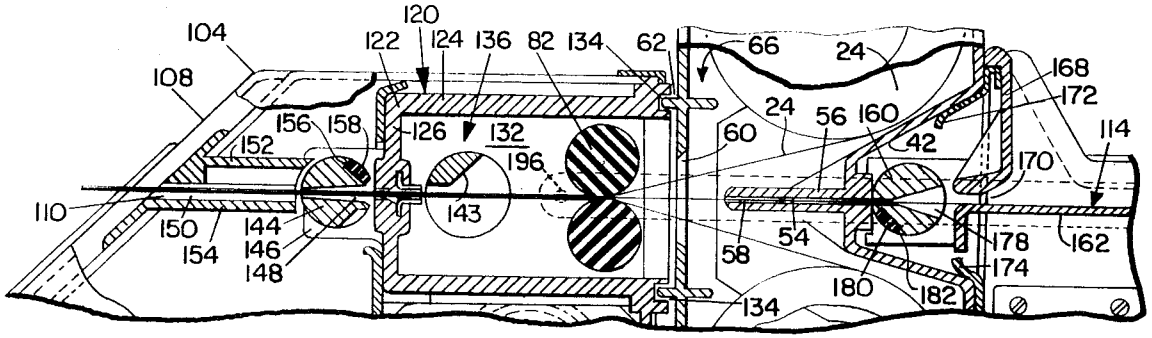
FIG. 7 is similar in some respects to FIG. 6 but shows the seals in the open or aligned positions.

The logic 1 input at A causes circuit 232 to provide a power output at C for energizing the seal solenoid 242 which results in the rotation of the seals 144 and 160 to the aligned or open positions shown in FIGS. 4 and 7. Seals 144 and 160 remain in the aligned position as long as solenoid 242 is energized.

Circuit 232 also is configured to perform processing cycle timing functions. Upon the closure of switch 238, indicating that a film unit is being inserted for processing, circuit 232 provides a delay, for example two seconds, and then provides a power output at D to energize the roller drive motor 230. This short delay provides time for the operator to slide the film unit 80 forwardly so that the leading end moves through the passageway 178 in seal 160, the cassette entry opening 52 and following guideway 54, the exit opening 60 in the front of the cassette, and into the nip of the rollers where it becomes frictionally engaged between the processing and base sheets 24 and 26.

Following the film insertion delay, circuit 232 energizes the drive roller motor 230 to advance the two sheets and film unit between the rollers to form the laminate 86. The leading end of the laminate 86 advances from the exit side of the rollers, passes under the blade portion of rotary knife 142 and exits from module 120 through the exit opening 128. From there, the leading end of laminate 86 then passes through the aligned passageway 146 of seal 144, following passageway 150 and exits section 16 through the laminate exit slot 110.

When a laminate 86 first advances through opening 110, it closes switch 240 which provides a logic 1 input at B. As long as any portion of the laminate 86 is in the exit opening 110, switch 240 will remain closed and provide its logic 1 input.

The logic 1 input at B also causes circuit 232 to supply electrical energy to the seal solenoid 242 so that the seal 144 and 160 will remain in the aligned position in response to laminate 86 extending out through opening 110 even after switch 232 automatically opens when it is cleared by the trailing end of film unit 80. Also, to insure that the seals 144 and 160 remain in the aligned position while the laminate 86 is being formed, circuit 232 preferably includes logic that monitors the flow of electrical power to roller drive motor 230 and maintains solenoid 242 in the energized state if motor 230 is operating regardless of the status of switches 238 and 240.

As the laminate 86 is being formed, the film unit 80 advances along its entry path through passageway 170. When the trailing edge of film unit 80 clears the actuator of switch 238 it automatically returns to its normal open state changing the logic input at A from 1 to 0. Circuit 232 responds to this change in input signal by providing a timed countdown period for deenergizing the roller drive motor 230. Based on the rate that sheets 24 and 26 in the film unit 80 are advanced by the rollers 82 and 84 and anticipating some coasting of the rollers after deenergization of motor 230, the time for deenergizing the motor is calculated so that the film unit trailing edge within the laminate will be located just forwardly of the path of travel of the rotary knife cutting edge 143. By this time, the leading end that the laminate extends out through slot 110 and closes switch 240 to maintain the seals 144 and 160 in the aligned position. By sensing when the trailing end of the film unit passes a predetermined point in passageway 170, and then timing the motor deenergization from that point, different length film units 80 may be processed without having to reset any of the control circuitry.

Following the deenergization of motor 230, circuit 232 provides a short time delay to insure that laminate advancement has stopped and then provides a power output at E to energize the knife solenoid 246. In response, the solenoid operated knife 142 rotates to pass its cutting edge 143 through the exit path of travel and severs the laminate from the trailing portions of sheets 24 and 26 extending out from the exit side of the rollers. This leaves the forward ends of the severed sheets in the nip of the pressure-applying rollers 82 and 84 in preparation for processing the next film unit 80.

The operator then manually withdraws the laminate from section 16. When the trailing end of the laminate 86 clears switch 240, the switch automatically returns to its normally open state changing the logic 1 input at B to logic 0. Circuit 232 responds to this logic signal change by deengerizing the seal solenoid 242 which causes the spring bias seals 144 and 160 to rotate back to the blocking positions of FIGS. 6 and 8A under the influence of their biasing springs. With the seals 144 and 160 in this position, the contents of cassette 12 are once again isolated from the ambient atmosphere surrounding apparatus 10.

In summary, apparatus 10 operates as follows. With no film unit 80 in passageway 170 to actuate switch 238, none of the electrical components are energized so that seals 144 and 160 assume the normal non-processing mode blocking positions of FIGS. 6 and 8A.

To load a fresh cassette 12 into well 14, handle 20 is pivoted to its up position of FIGS. 1 and 3 thereby moving section 18 to its retracted position. The factory installed tape seals over the cassette entry and exit openings 52 and 60, respectively, are manually removed by the operator and then cassette 12 is placed into well 14 to engage its bottom end with the cassette receiving and position clip 184. Handle 20 is pivoted downwardly causing section 18 to move forwardly. The rear seal 160 enters cassette notch 47 and engages boss 51. In response to continued forward movement of section 18 seal 160 pushes cassette 12 forwardly in well 14 to seat the rib 62 on the front of the cassette in the receiving channel 134 on the back end of module 120. At the forwardmost cassette engaging position, the rear seal is firmly pressed against boss 51 thereby compressively loading the cassette 12 between module 120 and the rear seal. Thus apparatus 10 includes entry seal means, in the form of rear seal 160, and exit seal means in the form of module 120 and front seal 144 which cooperate in the non-processing mode to block the cassette entry and exit opening to isolate the contents of cassette 12, especially processing sheet 24, from the ambient atmosphere surrounding apparatus 10. As noted earlier, this is done to isolate the processing sheet 24 from air surrounding the apparatus which would tend to cause evaporation of the processing liquid and/or deterioration of its chemical properties when in contact with the processing sheet for a prolonged period.

Although not shown in the drawings, cassette 12 is initially provided with the leading ends of the processing sheet 24 and backing sheet 26 connected together by a leader tape that spans the cassette exit opening 60. To prepare apparatus 10 for processing a film unit, the leading ends of sheets 24 and 26 must first be fed through the rollers 82 and 84. This may be done by employing a thin stiff metal or plastic threading sheet, provided with cassette 122 for this purpose, that is approximately the same size as a film unit 80 and is somewhat stiffer to accomplish the threading function.

The threading sheet is manually inserted into passage 170 to actuate switch 238 which cause the seals 144 and 160 to rotate from the blocking positions of FIGS. 6 and 8A to the aligned unblocking positions of FIGS. 4, 7 and 8B. During the insertion delay provided by circuit 232, the operator pushes the threading sheet along the entry path of travel. Just before opening 60, the leading edge of the threading sheet engages the leader tape, connecting sheets 24 and 26, which it carries into the nip of the rollers.

Following the insertion delay, roller motor 230 is energized to advance the connected leading ends of sheets 24 and 26 and the threading sheet therebetween through the rollers and along the exit path of travel. When the leading end of this assemblage passes through opening 110 switch 240 is closed insuring that seals 144 and 160 remain in the unblocking positions. When the trailing end of the threading sheet clears switch 238, circuit 232 shifts to its motor deenergization countdown mode and shuts off motor 230 at the appropriate time so the trailing end of the threading sheet is on the exit side of the rollers just beyond the path of the knife cutting edge 143. The knife solenoid 246 is energized and sheets 24 and 26 are severed leaving the portions just behind the cutting position threaded through the rollers. Upon withdrawing the threading sheet assemblage from opening 110, switch 240 returns to its open position thereby deenergizing the seal solenoid 242 which cause the seals 144 and 160 to rotate back to the non-processing mode blocking positions.

Apparatus 10 is now configured to process film units 80. The film unit is initially inserted into opening 170 to trip switch 238 and cause the seals 144 and 160 to rotate to the processing mode unblocking positions. The leading edge of the film unit is pushed into the nip of the rollers and the laminating operation proceeds to form laminate 86 as shown in FIGS. 5 and 7 in the manner previously described in detail herein.

In the illustrated embodiment processor 10 was shown to simultaneously apply both the processing sheet 24 and backing sheet 26 to the film unit 80. It should be understood that the backing sheet 26 is optional and it is within the scope of the present invention to eliminate it from cassette 12 and process a film unit 80 by only applying the processing sheet 24 to the designated surface thereof.

Because certain other changes or modifications may be made without departing from the spirit and scope of the invention involved herein, it is intended that all matter contained in the above description or shown in the accompanying drawings shall be interpreted as illustrative and not in a limiting sense.

What is claimed is:

1. A film processing apparatus having processing and non-processing modes of operation, said apparatus being configured for use with a cassette holding at least a processing sheet yieldably carrying, on one surface thereof, a substantially uniformly distributed supply of a film processing liquid, the cassette being of the type having a housing formed of vapor and gas impervious material and including an entry opening, through which an exposed film unit advanced along a film entry path is adapted to move into the cassette housing, and an exit opening through which the film unit and processing sheet are adapted to be advanced simultaneously from the housing, along an exit path of travel, in superposed relation with the processing liquid carrying surface facing a surface of the film unit adapted to be wetted with the processing liquid to initiate film processing, said processing apparatus comprising:

means for receiving and supporting such a cassette;

means for advancing the processing sheet and a film unit along the exit path of travel while applying compressive pressure thereto to facilitate wetting the film unit surface with the processing liquid;

entry sealing means having a non-processing mode of operation for blocking the cassette entry opening to prevent vapor and gas transmission therethrough, and a processing mode of operation for unblocking the entry opening to provide access thereto for a film unit being advanced along the entry path of travel; and exit sealing means having a non-processing mode of operation for blocking the cassette exit opening to prevent vapor and gas transmission therethrough so as to cooperate with said entry sealing means for isolating the processing sheet from the ambient atmosphere surrounding said apparatus, and a processing mode of operation for unblocking the exit opening to provide access to the exit opening for accommodating advancement of the processing sheet and film unit along the exit path of travel.

2. The processing apparatus of claim 1 wherein said entry and exit sealing means respectively include entry and exit seals mounted for movement between blocking and unblocking positions.

3. The processing apparatus of claim 2 wherein said entry and exit seals are mounted for rotary movement between said blocking and unblocking positions.

4. The processing apparatus of claim 2 wherein said means for advancing the processing sheet and film unit while applying compressive pressure thereto is located between the cassette exit opening and said exit seal.

5. The apparatus of claim 1 wherein the cassette has the entry opening on a rear side of the cassette and the exit opening on an opposite forward side of the cassette, said entry sealing means is configured to engage the rear side of the cassette and said exit sealing means is configured to engage the forward side of the cassette.

6. The apparatus of claim 5 wherein said entry and exit sealing means are mounted for movement relative to each other between an operative cassette engaging position and an inoperative retracted position wherein said entry and exit sealing means are spaced farther apart than when in said cassette engaging position to facilitate cassette insertion into and withdrawal from said cassette receiving and supporting means.

7. The apparatus of claim 6 having a first fixed section mounting said exit sealing means and a second section, mounting said entry sealing means, movable relative to said first section between said cassette engaging and retracted positions.

8. The apparatus of claim 7 further including a cassette receiving well, located between said first and second sections, having said cassette receiving and supporting means therein.

9. The apparatus of claim 5 further including means for compressively loading said entry and exit means against the forward and rear sides of the cassette.

10. The apparatus of claim 9 further including a first fixed section mounting said exit sealing means and a second section, mounting said entry sealing means, movable relative to said first section between said cassette engaging and retracted positions and said compressive loading means includes a mechanically advantaged arrangement for urging said second section toward said first section when said second section is in said cassette engaging position.

11. The apparatus of claim 1 wherein said entry and exit sealing means respectively include entry and exit seals mounted for rotary movement between blocking and unblocking positions.

12. The apparatus of claim 11 wherein said entry and exit seals each include a cylindrical body having a passageway slot extending therethrough and are configured such that said slots are aligned with the corresponding cassette entry and exit openings when located in said unblocking position and are not aligned with the corresponding entry and exit openings when located in said blocking positions.

13. The apparatus of claim 11 wherein said exit sealing means further includes a module formed of vapor and gas impervious material, said module being configured to be open at one end which is adapted to engage the cassette around the cassette exit opening and to have a module exit opening, at the end opposite said one end, that is selectively blocked and unblocked by said exit seal.

14. The apparatus of claim 13 wherein said means for advancing the processing sheet and film unit includes a pair of compressive pressure applying rollers.

15. The apparatus of claim 14 wherein said rollers are located in said module along exit path of travel.

16. The apparatus of claim 15 wherein the processing sheet is in the form of a roll located in the cassette and said apparatus further includes means in said module, between said rollers and module exit slot, for severing the processing sheet from the roll following its application to the film unit.

17. The apparatus of claim 11 further including means for simultaneously rotating said entry and exit seals such that they are moved between their respective blocking and unblocking positions in a coordinated manner.

18. The apparatus of claim 1 wherein the cassette also holds an adhesive bearing backing sheet adapted to be laminated to the opposite side of the film unit and said advancing and compressive pressure applying means is configured to advance the processing sheet, film unit, and backing sheet simultaneously while applying a compressive pressure thereto to form a laminate.

19. A film processing apparatus having processing and non-processing modes of operation, said apparatus being configured for use with a cassette holding a roll of a processing sheet, yieldably carrying on one surface thereof a substantially uniformly distributed supply of a film processing liquid, and a roll of a backing sheet carrying an adhesive on one surface thereof, the cassette being of the type having a housing formed of vapor and gas impervious material and including an entry opening, through which an exposed film unit advanced along a film entry path is adapted to be moved into the cassette housing, and an exit opening through which the processing sheet, film unit and backing sheet are adapted to be advanced simultaneously from the housing, along an exit path of travel, in superposed relation with the liquid carrying surface of the processing facing one surface of the film unit adapted to be wetted with the liquid to initiate film processing and with the adhesive carrying surface of the backing sheet facing an opposite surface of the film unit, said processing apparatus comprising, means for receiving and supporting such a cassette;

means for advancing the processing sheet, film unit and backing sheet along the exit path of travel while applying a compressive pressure thereto to form a laminate wherein the one surface of the film unit is wet with the processing liquid and the backing sheet adheres to the opposite surface of the film unit;

entry sealing means having a non-processing mode of operation for blocking the cassette entry opening to prevent vapor and gas transmission therethrough, and a processing mode of operation for unblocking the entry opening to provide access thereto for a film unit being advanced along the entry path of travel; and exit sealing means having a non-processing mode of operation for blocking the cassette entry opening to prevent vapor and gas transmission therethrough so as to cooperate with said entry sealing means for isolating the processing sheet from the ambient atmosphere surrounding said apparatus, and a processing mode of operation for unblocking the exit opening to provide access to the exit opening for accommodating advancement of the processing sheet, film unit and backing sheet along the exit path of travel.

20. The apparatus of claim 19 wherein said entry and exit sealing means are mounted for relative movement between an operative cassette engaging position and an inoperative retracted position wherein said entry and exit sealing means are spaced farther apart than when in said engaging position to facilitate cassette insertion into and withdrawal from said cassette receivng and supporting means.

21. The apparatus of claim 20 wherein said entry and exit sealing means respectively include rotary entry and exit seals movable between blocking and unblocking positions.

22. The apparatus of claim 20 wherein said exit sealing means includes a vapor and gas impervious module adapted to engage the cassette around the cassette exit opening.

23. The apparatus of claim 22 wherein said module includes a laminate exit opening and said exit sealing means includes a rotary seal movable between positions blocking and unblocking said laminate exit opening.

24. The apparatus of claim 22 wherein said advancing and pressure applying means includes a pair of rollers located in said module.

25. The apparatus of claim 24 further including means for severing the processing sheet and blocking sheet from their respective sheet rolls following formation of the laminate.

26. The apparatus of claim 25 wherein said severing means is located in said module between said rollers and laminate exit slot.

27. The apparatus of claim 19 further including means for severing the processing sheet and backing sheets from their respective rolls following formation of the laminate.

28. A film processing system comprising:

a cassette holding at least a processing sheet yieldably carrying, on one surface thereof, a substantially uniformly distributed supply of a film processing liquid, said cassette having a housing formed of vapor and gas impervious material and including an entry opening through which an exposed film unit advancedalong an entry path of travel is adapted to move into the cassette housing, and an exit opening through which the processing sheet and film unit are adapted to be advanced simultaneously from the housing, along an exit path of travel, in superposed relation with the liquid carrying surface facing a surface of the film unit adapted to be wetted with the processing liquid to initiate film processing; and a film processing apparatus having processing and non-processing modes of opeation, said apparatus including;

(a) means for receiving and supporting such a cassette;

(b) means for advancing the processing sheet and a film unit along the exit path of travel while applying a compressive pressure thereto to facilitate wetting the film unit surface with the processing liquid;

(c) entry sealing means having a non-processing mode of operation for blocking the cassette entry opening to prevent vapor and gas transmission therethrough, and a processing mode of operation for unblocking the entry opening to provide access thereto for a film unit being advanced along the entry path of travel; and (d) exit sealing means having a non-processing mode of operation for blocking the cassette exit opening to prevent vapor and gas transmission therethrough so as to cooperate with said entry sealing means for isolating the processing sheet from the ambient atmosphere surrounding said apparatus, and a processing mode of operation for unblocking the exit opening to provide access thereto for accommodating advancement of the processing sheet and film unit along the exit path of travel.

29. The system of claim 28 wherein said cassette further holds a backing sheet having an adhesive on one surface thereof and said backing sheet is adapted to be advanced through the cassette exit opening with the processing sheet and film unit so as to be adhered to the opposite side of the film unit to form a laminate.

30. The system of claim 29 wherein said processing and backing sheets are in the form of sheet rolls held in said cassette housing and said apparatus further includes means for severing the processing and backing sheets from their respective rolls following the formation of said laminate.

31. The system of claim 29 wherein said entry and exit sealing means are mounted for relative movement between an operative cassette engaging position and an inoperative retracted position.

32. The system of claim 28 wherein said entry and exit sealing means respectively include entry and exit seals that are rotatable between blocking and unblocking positions.

* * * * *